US009211431B2

(12) United States Patent
Hornback et al.

(10) Patent No.: US 9,211,431 B2
(45) Date of Patent: Dec. 15, 2015

(54) EXERCISE MACHINE

(71) Applicant: Group X, LLC, Greenwood, IN (US)

(72) Inventors: Jerome B Hornback, Greenwood, IN (US); Paula A Hornback, Greenwood, IN (US); Jeannette L. Keating, Greenwood, IN (US)

(73) Assignee: GROUP X, LLC, Greenwood, IN (US)

( * ) Notice: Subject to any disclaimer, the term of this patent is extended or adjusted under 35 U.S.C. 154(b) by 115 days.

(21) Appl. No.: 13/974,498

(22) Filed: Aug. 23, 2013

(65) Prior Publication Data

US 2014/0066276 A1 Mar. 6, 2014

Related U.S. Application Data

(60) Provisional application No. 61/694,873, filed on Aug. 30, 2012.

(51) Int. Cl.

| | |
|---|---|
| ***A63B 21/00*** | (2006.01) |
| ***A63B 21/068*** | (2006.01) |
| ***A63B 23/02*** | (2006.01) |
| ***A63B 23/04*** | (2006.01) |

(52) U.S. Cl.

CPC ..... *A63B 21/00047* (2013.01); *A63B 21/00069* (2013.01); *A63B 21/068* (2013.01); *A63B 21/1426* (2013.01); *A63B 23/0211* (2013.01); *A63B 23/0233* (2013.01); *A63B 23/0494* (2013.01); *A63B 2208/0252* (2013.01); *A63B 2208/0257* (2013.01)

(58) Field of Classification Search

CPC ..... A63B 21/00

USPC ..... 482/144, 142, 130, 907

See application file for complete search history.

(56) References Cited

U.S. PATENT DOCUMENTS

| | | | | |
|---|---|---|---|---|
| 4,200,279 | A | | 4/1980 | Lambert, Jr. |
| 4,226,415 | A | | 10/1980 | Wright |
| 4,387,894 | A | | 6/1983 | Baumann |
| 4,405,128 | A | | 9/1983 | McLaughlin et al. |
| 4,468,026 | A | | 8/1984 | Roark |
| 4,763,897 | A | | 8/1988 | Yakata |
| 4,854,578 | A | | 8/1989 | Fulks |
| 4,867,143 | A | * | 9/1989 | Morin ..... 606/244 |
| 4,893,812 | A | | 1/1990 | Dawson, Jr. et al. |
| 4,902,008 | A | | 2/1990 | Jones |
| 4,999,457 | A | * | 3/1991 | Fruchey ..... 564/223 |
| 5,031,905 | A | | 7/1991 | Walsh |
| 5,135,459 | A | | 8/1992 | Perry, Jr. |
| 5,256,126 | A | | 10/1993 | Grotstein |
| 5,356,359 | A | | 10/1994 | Simmons |
| 5,885,197 | A | * | 3/1999 | Barton ..... 482/144 |
| 6,296,594 | B1 | | 10/2001 | Simonson |
| 6,387,024 | B1 | | 5/2002 | Monti et al. |
| 6,491,607 | B2 | | 12/2002 | Simmons et al. |
| 7,435,207 | B2 | | 10/2008 | Cook et al. |
| 7,442,153 | B1 | | 10/2008 | Chasnov |
| 7,473,212 | B2 | | 1/2009 | Simmons |
| 7,935,038 | B2 | | 5/2011 | Tyree |
| 8,043,195 | B2 | | 10/2011 | Cunningham |

(Continued)

*Primary Examiner* — Jerome W Donnelly
(74) *Attorney, Agent, or Firm* — Barnes & Thornburg LLP

(57) ABSTRACT

An exercise machine for supporting a user during exercise includes a base and a platform assembly coupled to the base. The base is adapted to be supported on a floor and the platform assembly is mounted to the base so that the platform is supported above the floor. The platform assembly is configured to support a user performing an exercise.

19 Claims, 11 Drawing Sheets

(56) References Cited

U.S. PATENT DOCUMENTS

| | | | |
|---|---|---|---|
| 8,077,414 | B2 | 12/2011 | Rochat |
| 2002/0151419 | A1 | 10/2002 | Barnes et al. |
| 2002/0183171 | A1 | 12/2002 | Taylor et al. |
| 2006/0100070 | A1 | 5/2006 | Abdo |
| 2008/0064576 | A1 | 3/2008 | Tyree |
| 2011/0190104 | A1 | 8/2011 | Derrick |
| 2011/0218083 | A1 | 9/2011 | Staff |

* cited by examiner

EXERCISE MACHINE

PRIORITY CLAIM

This application claims priority under 35 U.S.C. §119(e) to U.S. Provisional Application Ser. No. 61/694,873, filed Aug. 30, 2012, which is expressly incorporated by reference herein.

BACKGROUND

The present disclosure is generally related to exercise equipment. More specifically, the present disclosure is related to exercise machines for exercising the legs and abdomen of a user.

Many pieces of exercise equipment are adapted to isolate particular muscle groups of the legs and/or the abdomen of a user. Such leg and/or abdomen exercise equipment typically includes weight plates and requires a large amount of floor space in an exercise facility. Some leg and/or abdomen exercise equipment concentrate loads on the knee joint of a user and may be uncomfortable to use. Some leg and/or abdomen exercise equipment includes a variety of moving parts, such as cables and pulleys, that add to the cost of manufacture and to the cost of maintenance.

SUMMARY

An exercise machine for supporting a user during exercise illustratively includes a base and a platform assembly coupled to the base. The base is adapted to be supported on a floor and the platform assembly is mounted to the base so that the platform is supported above the floor. The platform assembly is configured to support a user performing an exercise.

In illustrative embodiments, the platform assembly includes a beam and a dome. The beam is coupled to the base and the dome is coupled to the beam. The dome is configured to provide means for inducing isometric exercise from the user supported on the platform assembly by requiring the user to stabilize her body on the convex surface of the dome.

In illustrative embodiments, the platform assembly is coupled to the base to pivot relative to the base about a platform-assembly axis to adjust the difficulty of exercises performed by a user while supported on the platform assembly. The platform assembly is pivotable relative to the base to a plurality of positions including an inclined position in which a head end of the platform assembly is arranged above a foot end of the platform assembly and a declined position in which the head end of the platform assembly is arranged below the foot end of the platform assembly.

Additional features of the present disclosure will become apparent to those skilled in the art upon consideration of illustrative embodiments exemplifying the best mode of carrying out the disclosure as presently perceived.

BRIEF DESCRIPTIONS OF THE DRAWINGS

The detailed description particularly refers to the accompanying figures in which:

FIG. 6 is a rear perspective view of the exercise machine in the inclined mode of operation showing a user exercising muscle groups of the leg;

FIG. 7 is a side elevation view of the exercise machine in the inclined mode of operation showing a user exercising muscle groups of the leg;

FIG. 8 is a front perspective view of the exercise machine in the inclined mode of operation showing a user exercising muscle groups of the leg;

FIG. 9 is a rear perspective view of the exercise machine in the horizontal mode of operation showing a user exercising muscle groups of the leg;

FIG. 10 is a side elevation view of the exercise machine in the horizontal mode of operation showing a user exercising muscle groups of the leg;

FIG. 11 is a front perspective view of the exercise machine in the horizontal mode of operation showing a user exercising muscle groups of the leg;

FIG. 12 is a rear perspective view of the exercise machine in the declined mode of operation showing a user exercising muscle groups of the leg;

FIG. 13 is a side elevation view of the exercise machine in the declined mode of operation showing a user exercising muscle groups of the leg;

FIG. 14 is a front perspective view of the exercise machine in the declined mode of operation showing a user exercising muscle groups of the leg;

FIG. 15 is a front perspective view of the exercise machine in the inclined mode of operation showing a user exercising muscle groups of the abdomen;

FIG. 16 is a side elevation view of the exercise machine in the inclined mode of operation showing a user exercising muscle groups of the abdomen;

FIG. 17 is a rear perspective view of the exercise machine in the inclined mode of operation showing a user exercising muscle groups of the abdomen;

FIG. 18 is a front perspective view of the exercise machine in the horizontal mode of operation showing a user exercising muscle groups of the abdomen;

FIG. 19 is a side elevation view of the exercise machine in the horizontal mode of operation showing a user exercising muscle groups of the abdomen;

FIG. 20 is a rear perspective view of the exercise machine in the horizontal mode of operation showing a user exercising muscle groups of the abdomen;

FIG. 21 is a front perspective view of the exercise machine in the declined mode of operation showing a user exercising muscle groups of the abdomen;

FIG. 22 is a side elevation view of the exercise machine in the declined mode of operation showing a user exercising muscle groups of the abdomen;

FIG. 23 is a rear perspective view of the exercise machine in the declined mode of operation showing a user exercising muscle groups of the abdomen;

DETAILED DESCRIPTION

Figure 1:
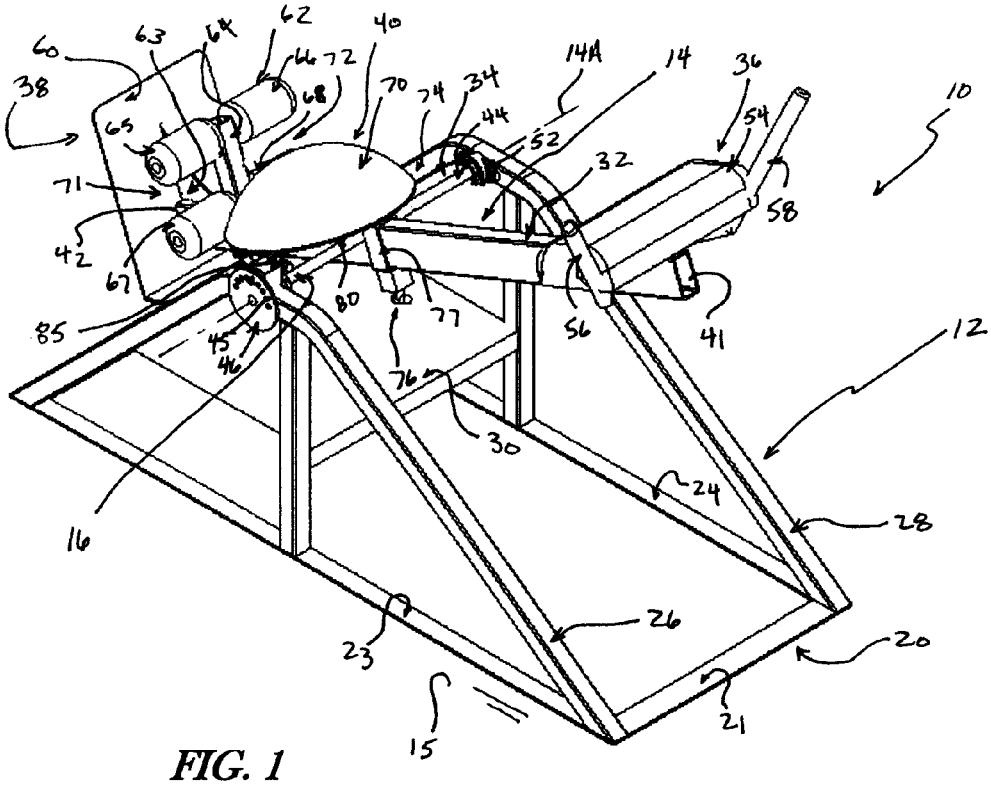
FIG. 1 is a top perspective view of an exercise machine for exercising muscle groups of the leg and the abdomen.
Figure 2:
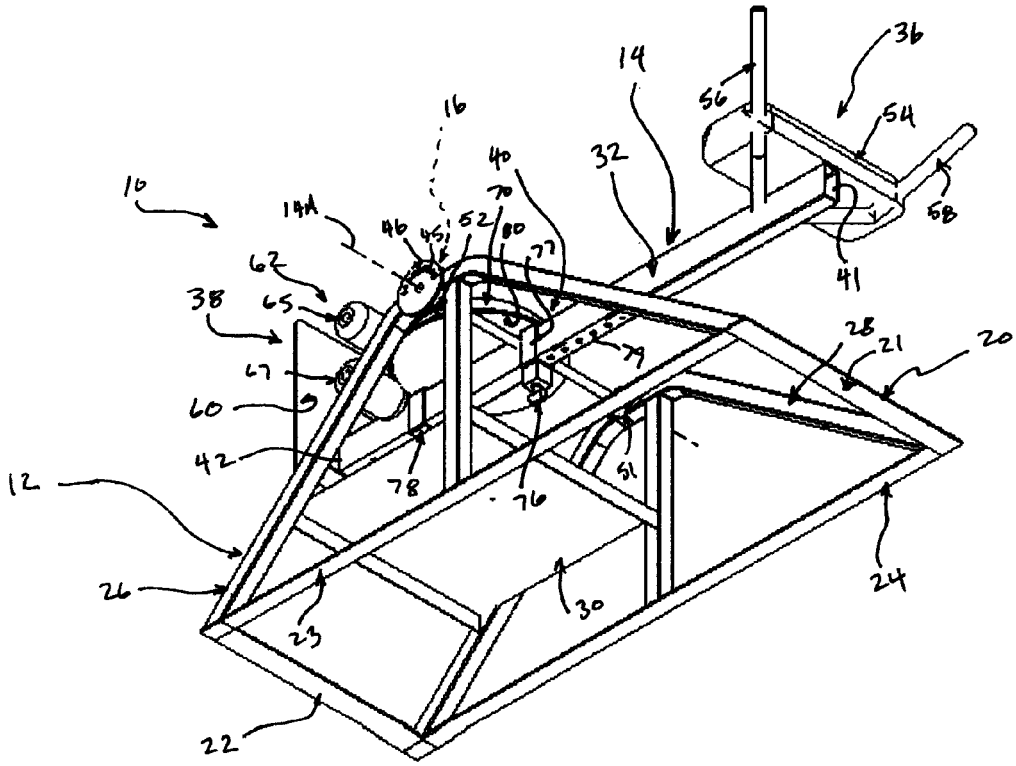
FIG. 2 is a bottom perspective view of the exercise machine of FIG. 1.

An illustrative exercise machine 10 shown in FIGS. 1 and 2 is adapted to support a user performing hamstring curls (sometimes called Nordic Curls) or stomach curls (sometimes called sit-ups or crunches). Hamstring curls dynamically exercise muscle groups of the leg including the hamstrings during pivoting of the user's torso about the knee joint as suggested in FIGS. 6-14. Stomach curls dynamically exercise muscle groups of the abdomen during pivoting of the user's torso about the hip joint as suggested in FIGS. 15-23.

In addition to the dynamic components of these exercises, the illustrative exercise machine 10 provides means for inducing isometric (or non-motion based) exercise from the user as suggested in FIGS. 6-23. More specifically, a curved dome 70 included in a central support 40 of the exercise machine 10 requires a user performing hamstring curls on the exercise machine 10 to isometrically exercise inner thigh muscles and gluteus maximus muscles to stabilize the rest of the body during the movements associated with hamstring curls. In addition, the curved dome 70 requires a user performing stomach curls on the exercise machine 10 to isometrically exercise groups of abdominal muscles and leg muscles to stabilize the rest of the body during the movements associated with stomach curls.

The illustrative exercise machine 10 includes a base 12, a platform assembly 14, and a blocker mechanism 16 as shown in FIG. 1. The base 12 is adapted to be supported on a floor 15. The platform assembly 14 is coupled to the base 12 to pivot about a platform-assembly axis 14A so that a user can adjust the difficulty of exercises performed while supported on the exercise machine 10. The blocker mechanism 16 is configured to hold the platform assembly 14 in a selected position relative to the base 12.

The base 12 includes a lower frame 20, a left side frame 26, a right side frame 28, and a mount plate 30 as shown, for example, in FIG. 1. Lower frame 20 is adapted to engage the floor 15 and illustratively includes a head end member 21, a foot end member 22, a left side member 23, and a right side member 24 that cooperate to form a rectangle. The left side frame 26 is arranged to extend upwardly from left side member 23 of lower frame 20. The right side frame 28 is arranged to extend upwardly from right side member 24. The left and the right side frames 26, 28 cooperate to supports platform assembly 14 above the floor 15. The mount plate 30 is illustratively coupled between the left and the right side frames 26, 28 and is supported by the left and the right side frames 26, 28 above the floor 15.

The platform assembly 14 illustratively includes a beam 32, a boom 34, a head-end support 36, a foot-end support 38, and a central support 40 as shown in FIG. 1. The beam 32 has a head end 41 and a foot end 42 and is supported between the left side frame 26 and the right side frame 28. The boom 34 is coupled between the beam 32 and the base 12. The head-end support 36 is coupled to the beam 32 at the head end 41 and is configured to support the head of a user and to provide a hand-hold for the user. The foot-end support 38 is coupled to the beam 32 at the foot end 42 and is configured to support a user's feet and lower legs. The central support 40 is coupled to the beam 32 between the head end 41 and the foot end 42 and is configured to support the knees or backside of a user during use of the exercise machine 10.

The boom 34 extends from the beam 32 to the left and the right side frames 26, 28 to couple the beam 32 to the left and the right side frames 26, 28 as shown, for example, in FIG. 1. The boom 34 includes a shaft 44 and a hitch 46 coupled to the shaft 44. The shaft 44 extends through the beam 32 and through support bearings 51, 52 included in the left and the right side frames 26, 28 to support the platform assembly 14 for movement about the pivot axis 14A. The hitch 46 is located along the pivot axis 14A and is formed to include slots 45 arranged around the pivot axis 14A.

The head-end support 36 illustratively includes a cushion pad 54, a left handle grip 56, and a right handle grip 58 as shown in FIG. 1. The cushion pad 54 is coupled to the beam 32 and is sized to support a user's head. The handle grips 56, 58 illustratively extend from the beam 32 outwardly toward the corresponding left or right side frames 26, 28 and away from the foot end 42 of the beam 32.

The foot-end support 38 illustratively includes a foot plate 60, a leg restraint 62, and a gusset 63 as shown in FIG. 1. The foot plate 60 is coupled to the foot end 42 of the beam 32 and extends from the beam 32 away from the base 12. The leg restraint 62 includes a pylon 64 arranged to extend away from the beam 32, a pair of upper rollers 65, 66 coupled to the pylon 64, and a pair of lower rollers 67, 68 coupled to the pylon 64. The upper rollers 65, 66 and the lower rollers 67, 68 of the leg restraint 62 cooperate with the pylon 64 of the leg restraint 62 to provide a left lower-leg receiving space 71 and a right lower-leg receiving space 72. The gusset 63 extends from the foot plate 60 to the beam 32 to reinforce the connection of the foot plate 60 to the beam 32.

Figure 13:
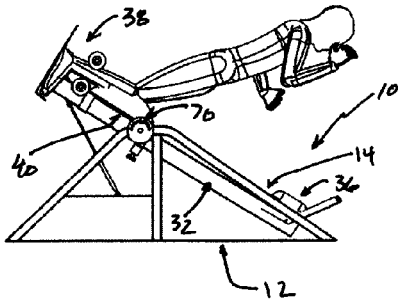
Figure 14:
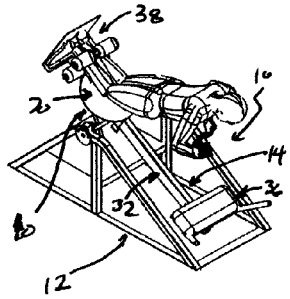
Figure 15:
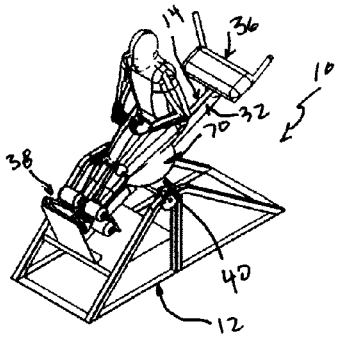
FIGS. 15-17 are a series of perspective views showing the exercise machine of FIGS. 1-5 in an inclined mode of operation and showing a user exercising muscle groups of the abdomen.
Figure 16:
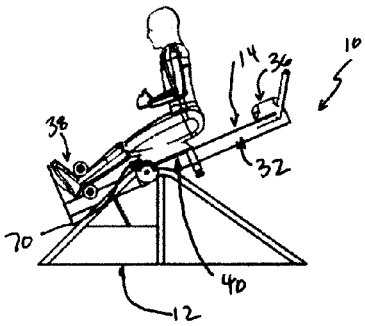
Figure 17:
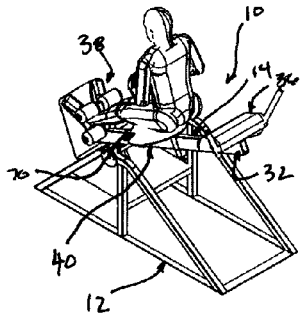
Figure 18:
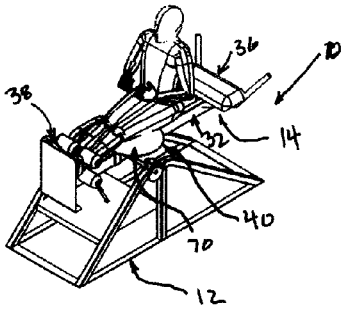
FIGS. 18-20 are a series of perspective views showing the exercise machine of FIGS. 1-5 in a horizontal mode of operation and showing a user exercising muscle groups of the abdomen.
Figure 19:
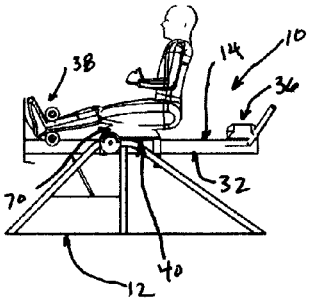
Figure 20:
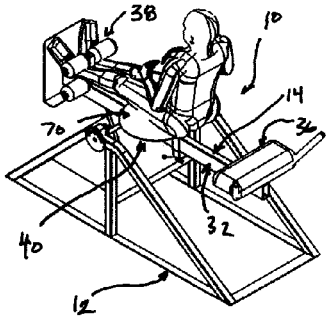
Figure 21:
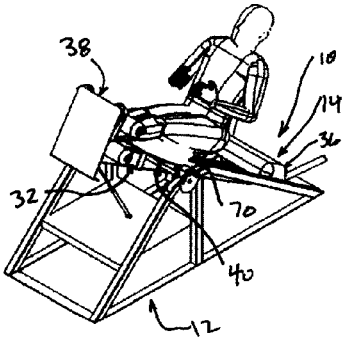
FIGS. 21-23 are a series of perspective views showing the exercise machine of FIGS. 1-5 in a declined mode of operation and showing a user exercising muscle groups of the abdomen.
Figure 22:
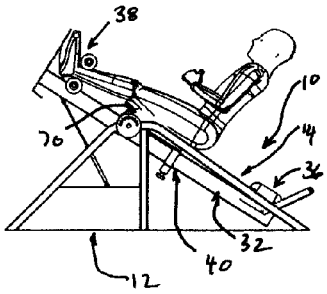
Figure 23:
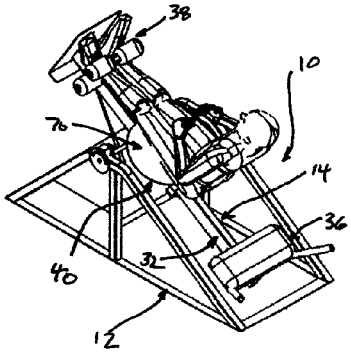

The foot plate 60 provides a resting place for a user's feet during use of the exercise machine 10 as shown in FIGS. 13 and 22. The leg restraint 62 receives the lower legs of a user during use of the exercise machine 10. The gusset 63 is arranged between a user's feet during use of the exercise machine 10. When the foot plate 60, the leg restraint 62, and the gusset 63 are engaged by a user's feet and lower legs, the foot-end support 38 provides means for bracing the user during mounting of the exercise machine 10 and/or during exercise so that the user's lower body is anchored to the exercise machine 10.

The central support 40 is illustratively coupled to the beam 32 to slide along the beam 32 between the head end 41 and the foot end 42 of the beam 32 as suggested in FIGS. 1 and 2. Movement of the central support 40 along the beam 32 allows a user to position the central support 40 relative to the foot-end support 38 so that the central support 40 underlies the user's knees or backside for proper support during use of the exercise machine 10. The central support 40 illustratively includes the curved dome 70, a carriage 74, and a central-support lock 76.

The dome 70 is illustratively a partial sphere as shown in FIG. 1. The dome 70 is illustratively hollow and is made from a polymeric material to allow some deformation and to provide a predetermined frictional interface to a user supported on the dome 70. In some embodiments, the dome 70 may be solid or partially solid and may allow no deformation. In some embodiments, the curved dome 70 may be made from other materials and/or may be covered with a pad or cushion.

The carriage 74 is coupled to the beam 32 and supports the dome 70 as shown, for example, in FIG. 1. The carriage 74 illustratively includes a forward bracket 77, a rear bracket 78, and a plate 80. The forward bracket 77 receives a portion of the beam 32 and is located between the boom 34 and the head end 41 of the beam 32. The rear bracket 78 receives another portion of the beam 32 and is located between the boom 34 and the foot end 42 of the beam 32. The plate 80 is round and is coupled to the forward and the rear brackets 77, 78.

Figure 5:
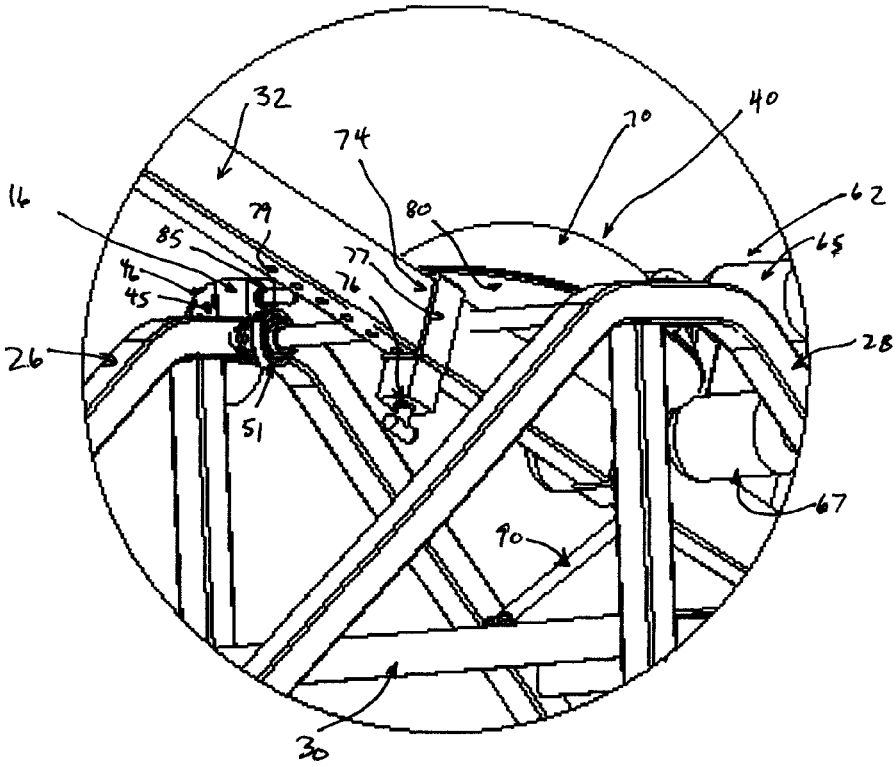
FIG. 5 is a detail view of a portion of FIG. 4.
Figure 4:
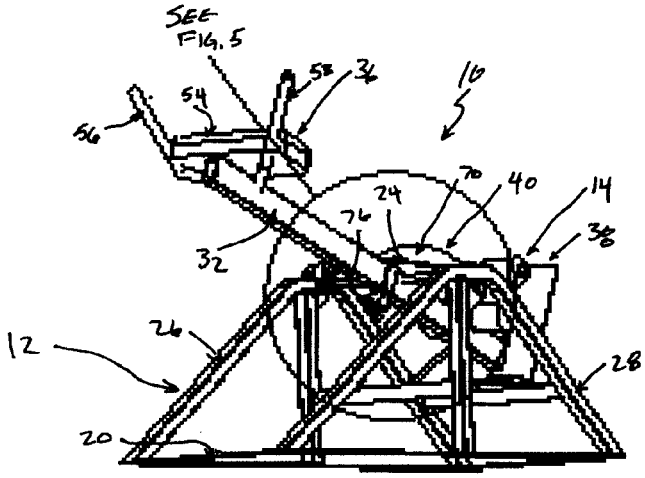
FIG. 4 is a side perspective view of the exercise machine of FIGS. 1-4.
Figure 6:
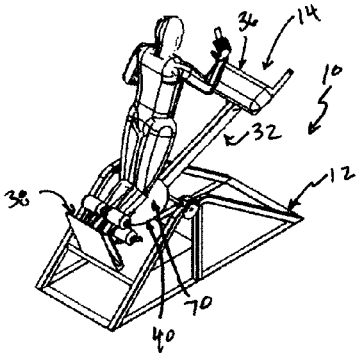
FIGS. 6-8 are a series of perspective views showing the exercise machine of FIGS. 1-5 in an inclined mode of operation and showing a user exercising hamstring, inner thigh, and gluteus maximus muscle groups of the leg.
Figure 7:
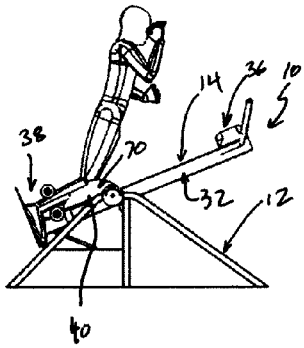
Figure 8:
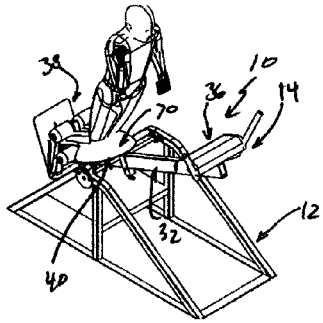
Figure 9:
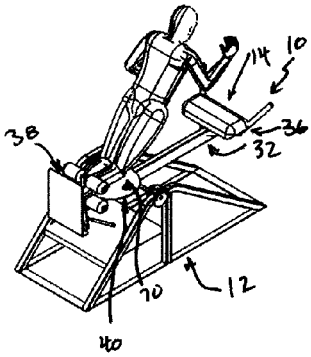
FIGS. 9-11 are a series of perspective views showing the exercise machine of FIGS. 1-5 in a horizontal mode of operation and showing a user exercising hamstring, inner thigh, and gluteus maximus muscle groups of the leg.
Figure 10:
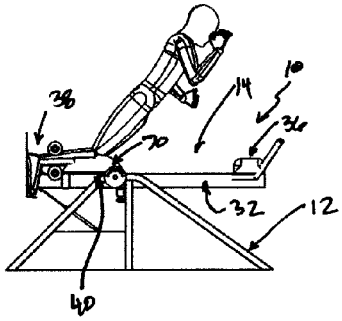
Figure 11:
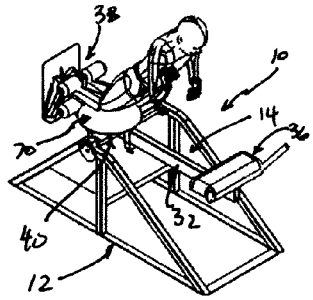
Figure 12:
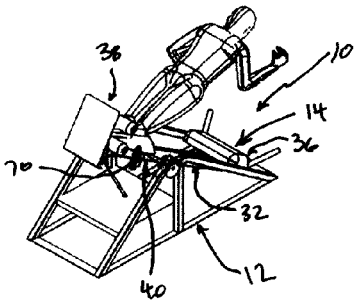
FIGS. 12-14 are a series of perspective views showing the exercise machine of FIGS. 1-5 in a declined mode of operation and showing a user exercising hamstring, inner thigh, and gluteus maximus muscle groups of the leg.

The central-support lock 76 is illustratively movable between a locked position and an unlocked position to selectively allow movement of the central support 40 along the beam 32 as suggested in FIGS. 4 and 5. In the locked position, the central-support lock 76 is arranged to block movement of the central support 40 along the beam 32. In the unlocked position, the central-support lock 76 is arranged to allow movement of the central support 40 along the beam 32. In the illustrative embodiment, the central-support lock 76 is a spring pin sized to be received on of a in a series of holes 79 formed in the beam 32. In other embodiments, other locking mechanisms (clamps, wing bolts, etc.) may provide the central-support lock 76.

The blocker mechanism 16 illustratively includes a platform-assembly lock 85 coupled to the base 12 and movable from a locked position to an unlocked position as suggested in FIG. 1. In the locked position, the platform-assembly lock 85 engages the hitch 46 of the platform assembly 14 to block movement of the platform assembly 14 about the platform-assembly axis 14A. In the unlocked position, the platform-assembly lock 85 disengages the hitch 46 of the platform assembly 14 to allow movement of the platform assembly 14 about the platform-assembly axis 14A. In the illustrative embodiment, the platform-assembly lock 85 is a spring pin sized to be received in one of the slots 45 formed in the hitch 46. In other embodiments, other locking mechanisms (clamps, wing bolts, etc.) may provide the platform-assembly lock 85.

The platform assembly 14 is movable relative to the base 12 about the platform-assembly axis 14A between an inclined position, a horizontal position, and a declined position as shown generally in FIGS. 6-23. The platform assembly 14 may be moved among or between the inclined, horizontal, and declined positions to adjust the difficulty of performing exercises targeting muscle groups of the legs or the abdominals.

In the inclined position, the head end 41 of the beam 32 is arranged above the foot end 42 of the beam 32 as shown, for example, in FIGS. 6-8 and 15-17. In the horizontal position, the head end 41 of the beam 32 is arranged at generally the same height as the foot end 42 of the beam 32 as shown, for example, in FIGS. 9-11 and 18-20. In the declined position, the head end 41 of the beam 32 is arranged below the foot end 42 of the beam 32 as shown, for example, in FIGS. 12-14 and 21-23.

Figure 3:
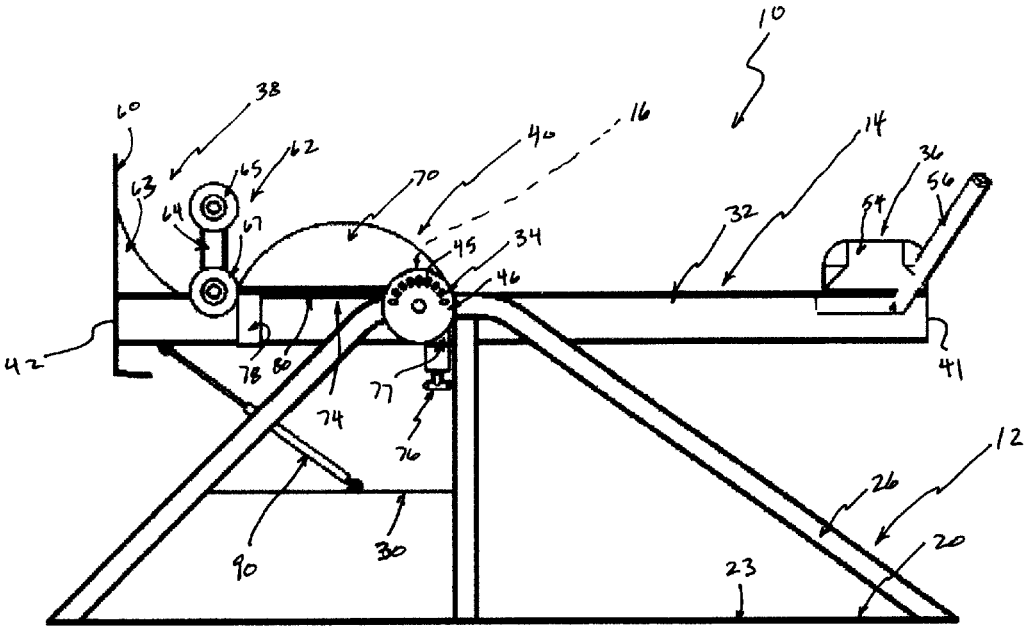
FIG. 3 is a side elevation view of the exercise machine of FIGS. 1 and 2.

The exercise machine 10 also includes a biasing member 90 coupled between the base 12 and the platform assembly 14 as shown in FIG. 3. The biasing member 90 is illustratively a gas spring arranged to extend between the mount plate 30 and the beam 32. The biasing member 90 is configured to provide resistance to movement of the platform assembly 14 relative to the base 12 to reduce the speed at which the platform assembly 14 is moved between the inclined position and the declined position.

A method of exercise using the exercise machine 10 illustratively includes unlocking the platform-assembly lock 85 by pulling the spring pin to allow the platform assembly 14 to move relative to the base 12. Then, the method includes pivoting the platform assembly 14 about the platform-assembly axis 14A to a desired angle relative to the base 12 and locking the platform-assembly lock 85 by releasing the spring pin. Next, the method includes unlocking the central-support lock 76 by pulling the spring pin. The method further includes moving the central support 40 along the beam 32 to a desired position and locking the central-support lock 76 by releasing the spring pin. The method then includes performing hamstring curls or stomach curls while on the exercise machine 10.

Performing hamstring curls on the exercise machine 10 includes mounting the exercise so that a user's knees are supported on the dome 70 and the user's feet and lower legs are braced by the foot-end support 38. Performing hamstring curls also includes pivoting the user's torso and upper leg about the knee joint.

Performing stomach curls on the exercise machine 10 includes mounting the exercise so that a user's backside (upper leg or butt) are supported on the dome 70 and the user's feet and lower legs are braced by the foot-end support 38. Performing stomach curls also includes pivoting the user's torso about the hip joint.

Another illustrative exercise machine 210 is shown in FIGS. 24-28. The exercise machine 210 is substantially similar to the exercise machine 10 shown in FIGS. 1-23 and described herein. Accordingly, similar reference numbers in the 200 series indicate features that are generally common between the exercise machine 10 and the exercise machine 210. The description of the exercise machine 10 is hereby incorporated by reference to apply to the exercise machine 210, except in instances when it conflicts with the specific description or drawings of exercise machine 210.

Figure 24:
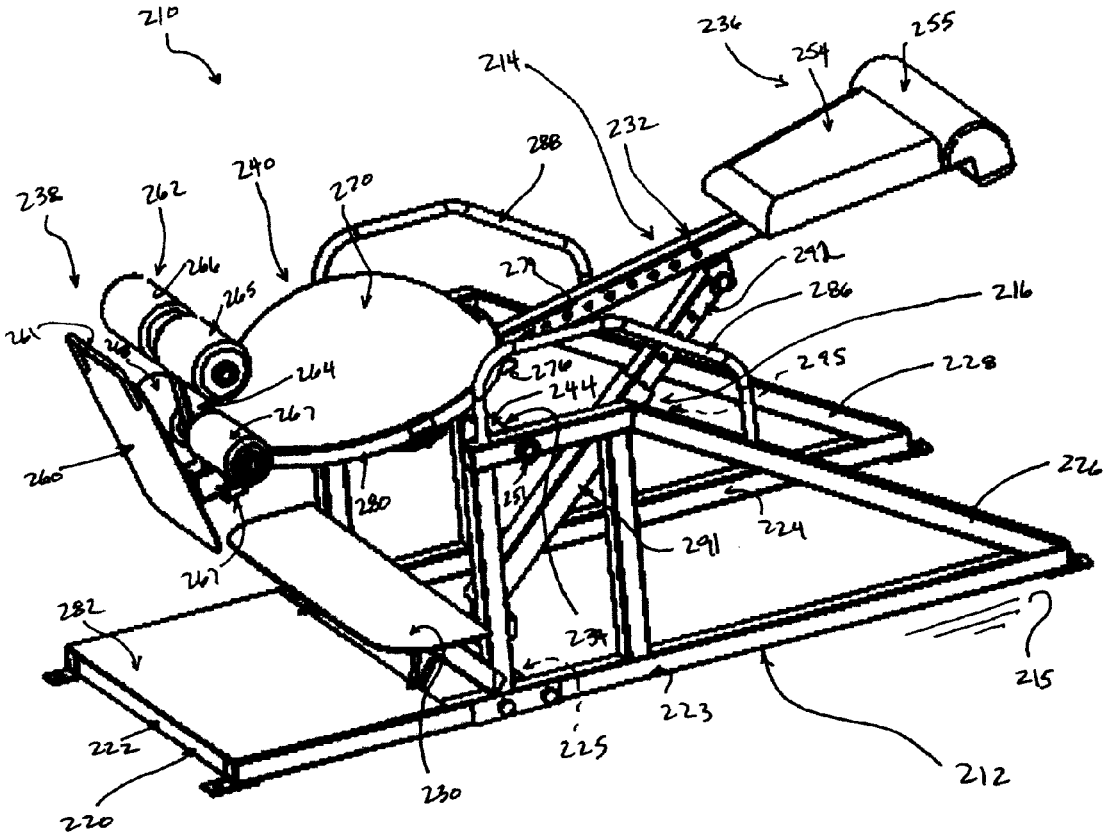
FIG. 24 is a front side perspective view of another exercise machine for exercising muscle groups of the leg and the abdomen.

Unlike exercise machine 10, with regard to the base 212 of exercise machine 210, the base 212 includes a left handle 286 and a right handle 288 as shown in FIG. 24. The left handle 286 is illustratively a generally U-shaped member that extends upwardly from the left side frame 226 of the base 212; and, the right handle 288 is a generally U-shaped member extends upwardly from the right side frame 228 of the base 212.

Also regarding the base 212, the lower frame 220 includes a step plate 282 coupled to the foot end member 222, the left member 223, and the right member 224 to rigidify lower frame 220 as shown in FIG. 24. The lower frame 220 also includes a cross member 225 that extends from the left side member 223 to the right side member 224 that is spaced apart from a head end 241 of the lower frame 220 rather than a head end member as shown in FIG. 24.

With regard to the platform assembly 214, the boom 234 does not include a hitch. The head-end support 236 includes a grip 255 formed monolithically with the cushion pad 254 rather than left and right handle grips as shown in FIG. 24. The grip 255 extends from the cushion pad 254 away from the foot end 242 of the beam 232 and toward the left and the right side frames 226, 228 of the base 212.

Figure 28:
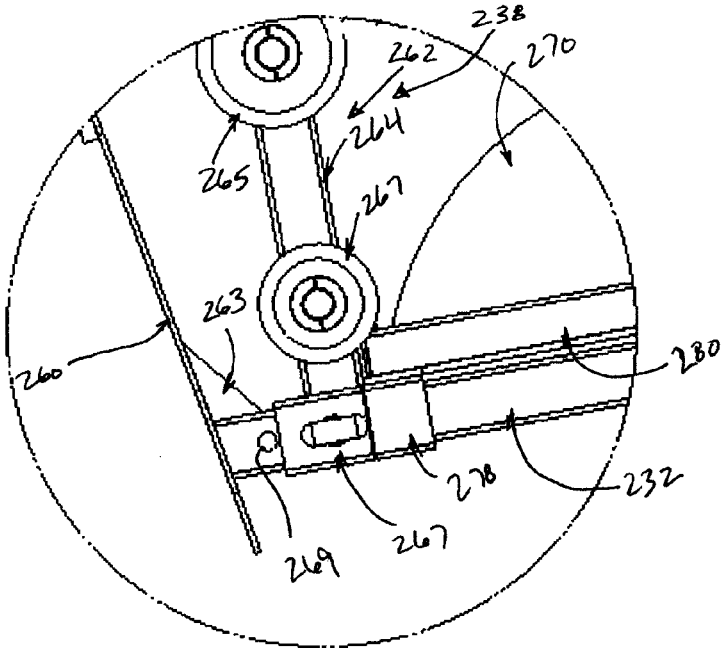
FIG. 28 is a detail view of a portion of FIG. 27.
Figure 27:
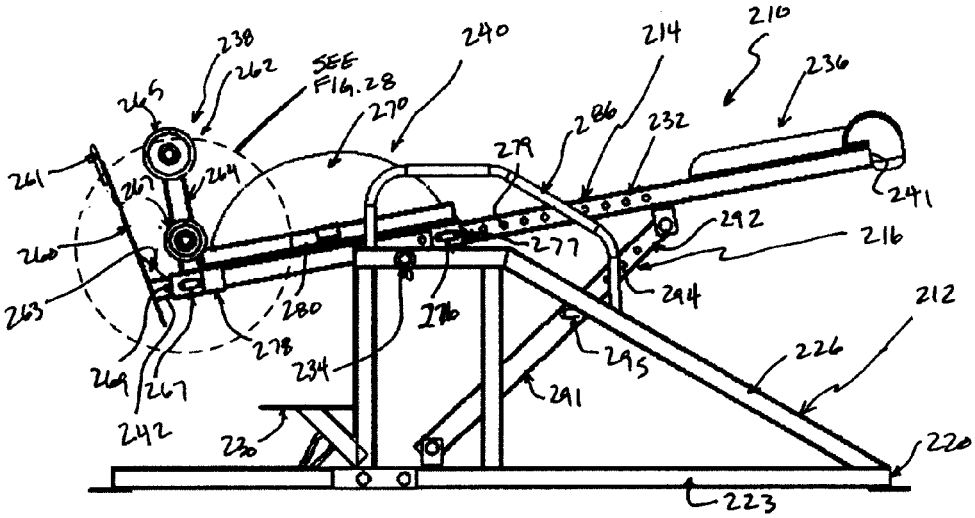
FIG. 27 is a side elevation view of the exercise machine of FIGS. 24-26.

The foot plate 260 of the foot-end support 238 is coupled to the beam 232 to slide toward and away from the beam 232 and the foot-end support 238 includes a foot-plate lock 267 as suggested in FIGS. 27 and 28. The foot-plate lock 267 is configured to selectively block or allow movement of the foot plate 260 relative to the beam 232. The foot-end support 238 also includes a handle 261 coupled to the foot plate 260 as shown in FIG. 24. The handle 261 extends from the foot plate 260 away from the beam 232.

The foot-plate lock 267 is coupled to the beam 232 and movable from a locked position to an unlocked position as suggested in FIG. 28. In the locked position, the foot-plate lock 267 engages the foot plate 260 to block movement of the foot plate 260 relative to the beam 232. In the unlocked position, the foot-plate lock 267 disengages the foot plate 260 to allow movement of the foot plate 260 relative to the beam 232. In the illustrative embodiment, the foot-plate lock 267 is a spring pin sized to be received in one a series of holes 269 formed in the foot plate 260. In other embodiments, other locking mechanisms (clamps, wing bolts, etc.) may provide the foot-plate lock 267.

Figure 26:
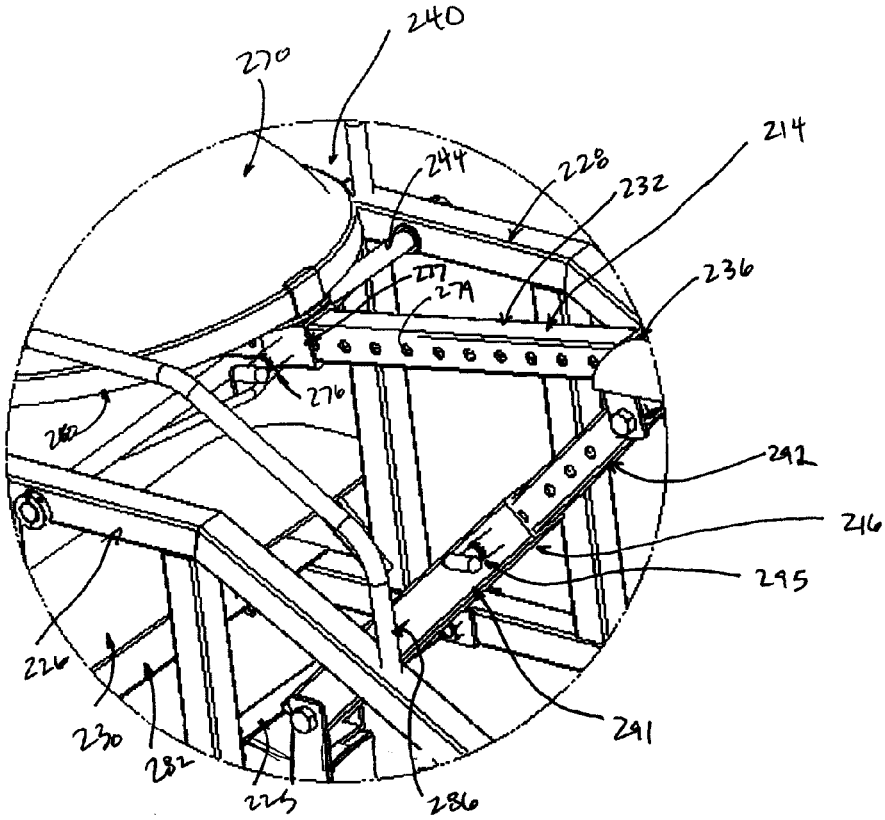
FIG. 26 is a detail view of a portion of FIG. 25.
Figure 25:
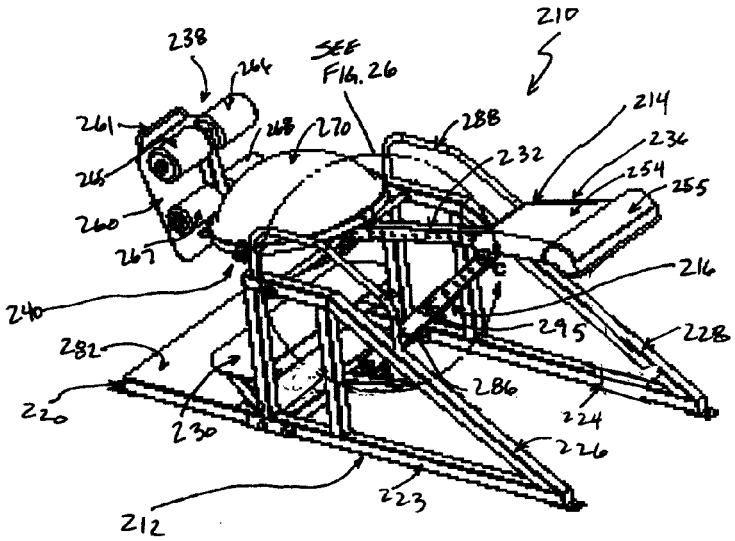
FIG. 25 is a rear side perspective view of the exercise machine of FIG. 24.

With regard to the blocker mechanism 216, the blocker mechanism 216 includes a first strut 291, a second strut 292, and a platform-assembly lock 295 as shown in FIGS. 25 and 26. The first strut 291 is coupled to the cross member 225 of the base 212 to pivot relative to the base 212. The second strut 292 is coupled to the beam 232 to pivot relative to the platform assembly 214. The first and the second struts 291, 292 are illustratively telescopically engaged with one another to slide relative to one another. The platform-assembly lock 295 is configured to selectively block the first and the second struts 291, 292 from moving relative to one another and, to thereby selectively block movement of the platform assembly 214 relative to the base 212.

The platform-assembly lock 295 is coupled to the first strut 291 and is movable from a locked position to an unlocked position as suggested in FIGS. 25 and 26. In the locked position, the platform-assembly lock 295 engages the second strut 292 to block movement of the second strut 292 relative to the first strut 291 and to thereby block movement of the platform assembly 214 about the platform-assembly axis 214A. In the locked position, the platform-assembly lock 295 disengages the second strut 292 to allow movement of the second strut 292 relative to the first strut 291 and to thereby allow movement of the platform assembly 214 about the platform-assembly axis 214A.

In the illustrative embodiment, the platform-assembly lock 295 is a spring pin sized to be received in one of a series of holes 294 formed in the second strut 292. In other embodiments, other locking mechanisms (clamps, wing bolts, etc.) may provide the platform-assembly lock 295.

Figure 29:
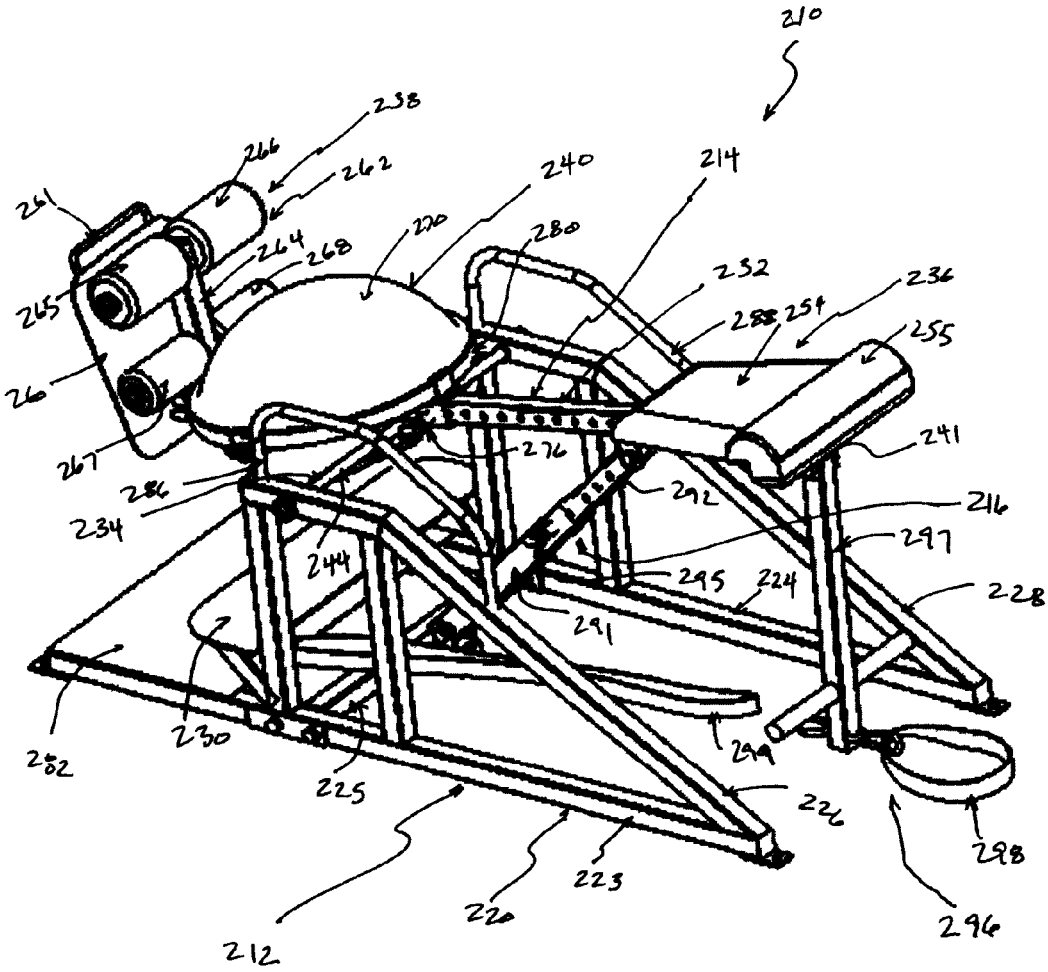
FIG. 29 is a perspective view of the exercise machine of FIGS. 24-28 with an optional accessory system.

The exercise machine 210 is shown with an illustrative accessory system 296 in FIG. 29. The accessory system 296 includes a pendulum 297, a strap 298, and a band 299 as shown, for example, in FIG. 29. The pendulum 297 is illustratively T-shaped and is coupled to the beam 232 at the head end 241 of the beam 232. The strap 298 is coupled to the pendulum 297 and is spaced apart from the beam 232. The band 299 is illustratively an elastic band coupled to the cross member 225 of the base 212. The accessory system 296 provides means for performing reverse glute extendsions while being supported on the platform assembly 214.

Figure 30:
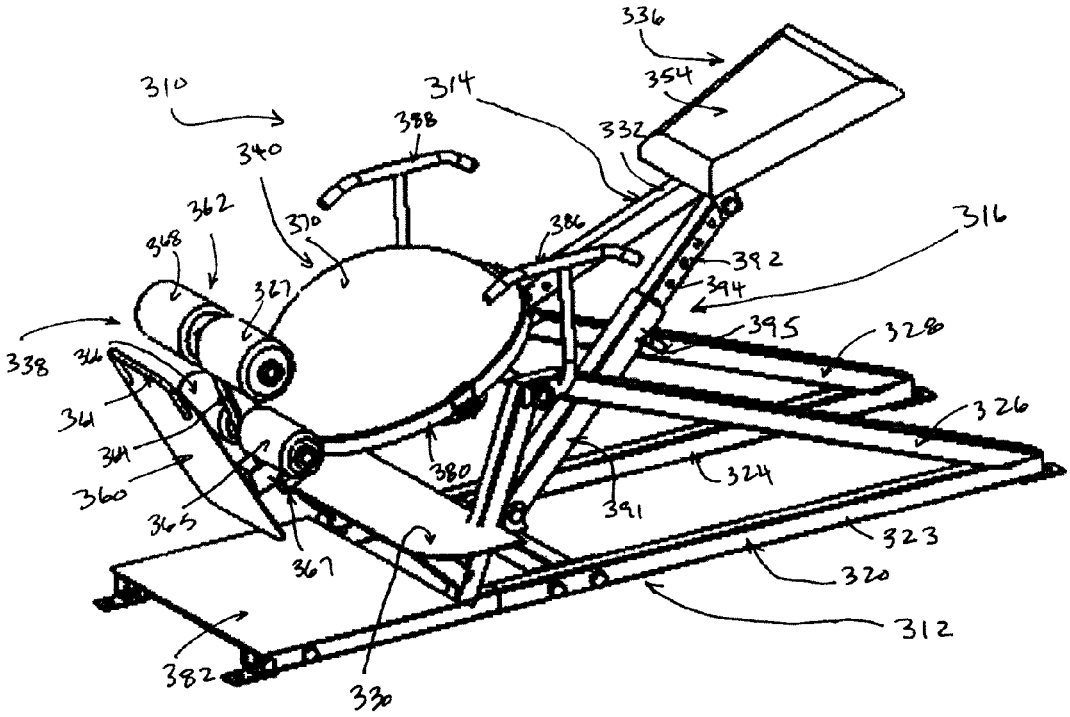
FIG. 30 is a perspective view of yet another exercise machine for exercising muscle groups of the leg and the abdomen.
Figure 31:
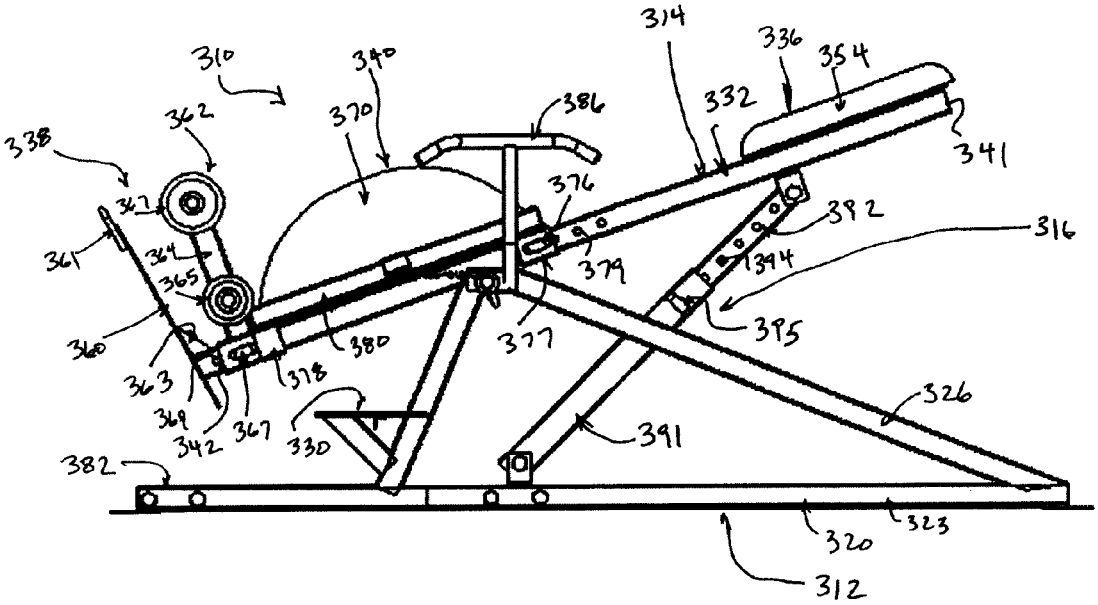
FIG. 31 is a side elevation view of the exercise machine of FIG. 30.
Figure 32:
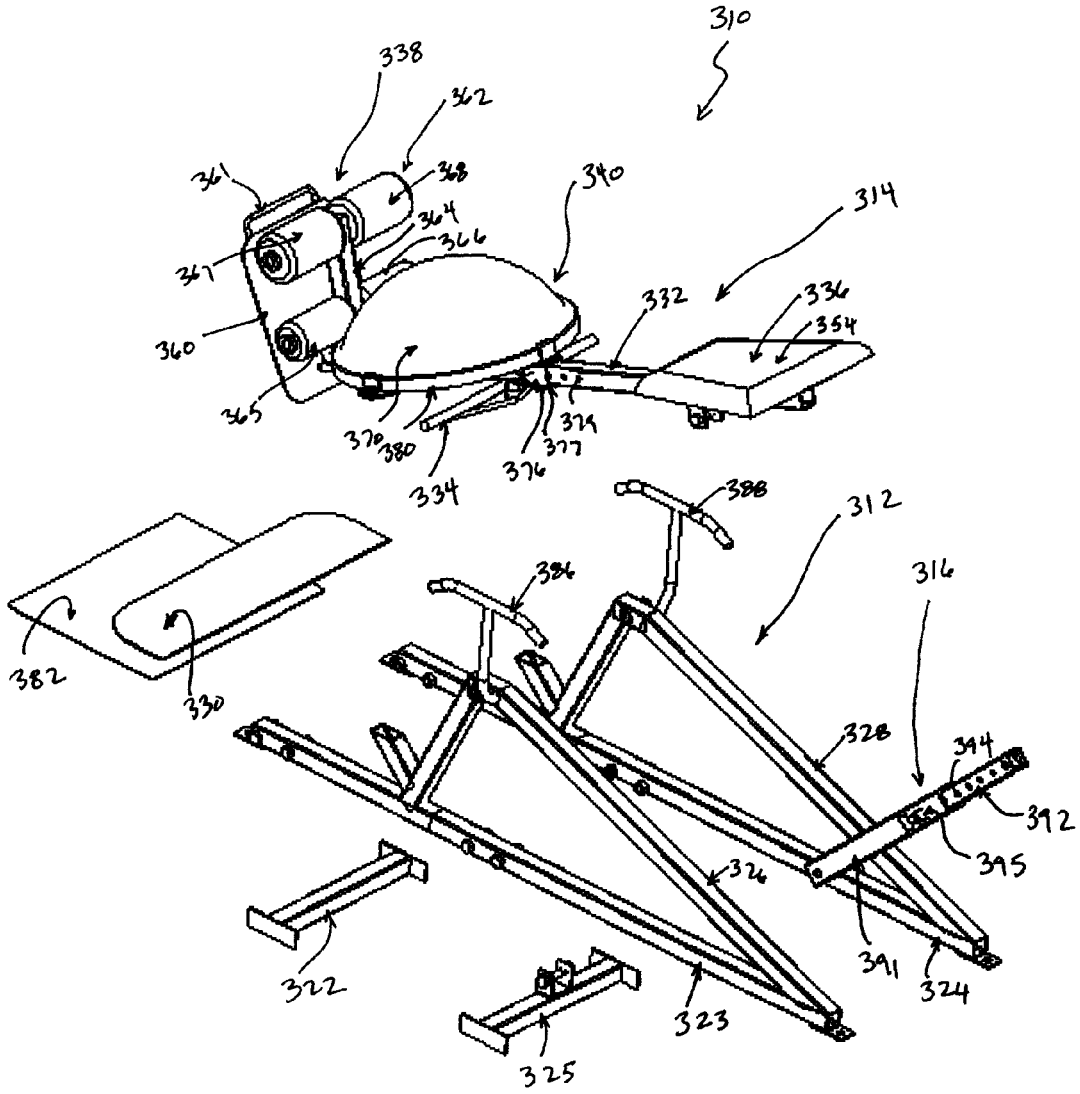
FIG. 32 is an exploded assembly view of the exercise machine of FIGS. 30 and 31.

Yet another illustrative exercise machine 310 is shown in FIGS. 30-32. The exercise machine 310 is substantially similar to the exercise machine 210 shown in FIGS. 24-29 and described herein. Accordingly, similar reference numbers in the 300 series indicate features that are generally common between the exercise machine 210 and the exercise machine 310. The description of the exercise machine 210 (including reference to exercise machine 10) is hereby incorporated by reference to apply to the exercise machine 310, except in instances when it conflicts with the specific description or drawings of exercise machine 310.

Unlike the exercise machine 210, the left handle 386 is illustratively a generally T-shaped member that extends upwardly from the left side frame 326; and, the right handle 388 is a generally T-shaped member that extends upwardly from the right side frame 328. With regard to the platform assembly 314, the head-end support 336 does not include a grip.

The invention claimed is:

1. An exercise machine comprising a base adapted to be supported on a floor, a platform assembly coupled the base for movement relative to the base about a platform-assembly axis, the platform assembly including a beam having a head end spaced apart from the platform-assembly axis in a first direction and a foot end spaced apart from the platform-assembly axis in a second direction opposite the first direction, a foot-end support coupled to the beam at the foot end of the beam, and a central support coupled to the beam to slide along the beam between the head end and the foot end of the beam, and a platform-assembly lock coupled to the base and movable relative to the base from a locked position arranged to block movement of the platform assembly about the platform-assembly axis to an unlocked position arranged to allow movement of the platform assembly about the platform-assembly axis, wherein the central support includes a carriage coupled to the beam to slide along the beam, a curved dome coupled to the carriage for movement therewith, and a central-support lock that is movable from a locked position arranged to block movement of the carriage and the curved dome along the beam to an unlocked position arranged to allow movement of the carriage and curved dome along the beam.

2. The exercise machine of claim 1, wherein the carriage includes a first bracket coupled to the beam and spaced apart from the platform-assembly axis in the first direction, a second bracket coupled to the beam and spaced apart from the platform-assembly axis in the second direction, and a plate coupled to the first bracket and the second bracket.

3. The exercise machine of claim 2, wherein the plate is round and the curved dome is a partial sphere arranged to extend upwardly from the plate.

4. The exercise machine of claim 1, wherein the foot-end support includes a foot platform and a leg restraint.

5. The exercise machine of claim 4, therein the leg restraint includes a pylon, a pair of upper rollers coupled to the pylon, and a pair of lower rollers coupled to the pylon to provide a left lower-leg receiving space and a right lower-leg receiving space.

6. An exercise machine comprising a base adapted to be supported on a floor, a platform assembly coupled the base for movement relative to the base about a platform-assembly axis, the platform assembly including a beam having a head end spaced apart from the platform-assembly axis in a first direction and a foot end spaced apart from the platform-assembly axis in a second direction opposite the first direction, a foot-end support coupled to the beam at the foot end of the beam, and a central support coupled to the beam to slide along the beam between the head end and the foot end of the beam, and a platform-assembly lock coupled to the base and movable relative to the base from a locked position arranged to block movement of the platform assembly about the platform-assembly axis to an unlocked position arranged to allow movement of the platform assembly about the platform-assembly axis, wherein the foot-end support includes a foot platform and a leg restraint, and wherein the foot platform includes a foot plate coupled to the beam to slide relative to the beam and a foot-plate lock movable from a locked position arranged to block movement of the foot plate relative to the beam to an unlocked position arranged to allow movement of the foot plate relative to the beam.

7. The exercise machine of claim 1, wherein the platform assembly includes a head-end support coupled to the beam at the head end of the beam.

8. The exercise machine of claim 7, wherein the head-end support includes a cushion coupled to the beam and a hand grip coupled to the beam.

9. The exercise machine of claim 1, wherein the platform assembly is coupled to the base to pivot from an inclined position in which the foot end of the beam is arranged below the head end of the beam to a declined position in which the head end of the beam is arranged below the foot end of the beam.

10. An exercise machine comprising a base adapted to be supported on a floor, a platform assembly coupled to the base to pivot about a first pivot axis, the platform assembly including a beam and a curved dome coupled to the beam to slide along the beam between a head end and a foot end of the beam, and a blocker mechanism coupled to the base and configured to hold the platform assembly in a selected position relative to the base.

11. The exercise machine of claim 10, wherein the platform assembly includes a hitch arranged along the first pivot axis and blocker mechanism includes a platform-assembly lock movable from a locked position engaged with the hitch to block movement of the platform assembly about the first pivot axis to an unlocked position disengaged from the hitch to allow movement of the platform assembly about the first pivot axis.

12. The exercise machine of claim 10, wherein the blocker mechanism includes a first strut coupled to the base to pivot about a second pivot axis, a second strut coupled to the beam to pivot about a third pivot axis and coupled to the first strut to slide along the first strut, and a platform-assembly lock moveable from a locked position arranged to block movement of the second strut relative to the first strut to an unlocked position arranged to allow movement of the second strut relative to the first strut.

13. The exercise machine of claim 12, wherein the second strut is coupled to the first strut to telescope relative to the first strut.

14. The exercise machine of claim 10, wherein the platform assembly includes a central-support lock movable from a locked position arranged to block movement of the curved dome along the beam to an unlocked position arranged to allow movement of the curved dome along the beam.

15. The exercise machine of claim 14, wherein the platform assembly includes a plate that underlies the curved dome and a first bracket coupled to the plate, the first bracket arranged to receive a portion of the beam.

16. The exercise machine of claim 10, wherein the platform assembly includes a foot plate coupled to the foot end of the beam to slide relative to the beam and a foot-plate lock movable from a locked position arranged to block movement of the foot plate relative to the beam to an unlocked position arranged to allow movement of the foot plate relative to the beam.

17. An exercise machine comprising a base adapted to be supported on a floor, a beam coupled to the base, and a central support coupled to the beam to slide along the beam between a head end and a foot end of the beam, the central support including a carriage coupled to the beam to slide along the beam, a curved dome coupled to the carriage for movement therewith, and a central-support lock that is movable from a locked position arranged to block movement of the carriage and the curved dome along the beam to an unlocked position arranged to allow movement of the carriage and curved dome along the beam.

18. The exercise machine of claim 17, further comprising a foot-end support coupled to the beam at the foot end of the beam wherein the foot-end support includes a foot platform and a leg restraint and the leg restraint includes a pylon, a pair of upper rollers coupled to the pylon, and a pair of lower rollers coupled to the pylon to provide a left lower-leg receiving space and a right lower-leg receiving space.

19. The exercise machine of claim 18, further comprising a cushion coupled to the beam at the head end of the beam sized to support a user's head.

* * * * *